US010537185B2

(12) United States Patent
Creekmuir et al.

(10) Patent No.: US 10,537,185 B2
(45) Date of Patent: Jan. 21, 2020

(54) ACCELERATED CALIBRATION SYSTEM FOR A SMART RESPONSE TECHNOLOGY MATTRESS

(71) Applicants: DREAMWELL, LTD., Las Vegas, NV (US); WCW Incorporated, Manchester Center, VT (US)

(72) Inventors: William C. Creekmuir, Atlanta, GA (US); Scott H. Smalling, Roy, WA (US); Edgar C. Gardner, Roswell, GA (US); Jeff Wilkinson, Bennington, VT (US)

(73) Assignees: DREAMWELL, LTD., Las Vegas, NV (US); WCW INCORPORATED, Manchester Center, VT (US)

( * ) Notice: Subject to any disclaimer, the term of this patent is extended or adjusted under 35 U.S.C. 154(b) by 471 days.

(21) Appl. No.: 14/661,378

(22) Filed: Mar. 18, 2015

(65) Prior Publication Data

US 2015/0265065 A1 Sep. 24, 2015

Related U.S. Application Data

(60) Provisional application No. 61/954,982, filed on Mar. 18, 2014.

(51) Int. Cl.
*A47C 27/10* (2006.01)
*A47C 27/08* (2006.01)
(Continued)

(52) U.S. Cl.
CPC ..... *A47C 27/088* (2013.01); *A47C 27/083* (2013.01); *A47C 23/04* (2013.01);
(Continued)

(58) Field of Classification Search
CPC ..... A47C 31/123; A47C 31/12; A47C 23/04; A47C 27/081; A47C 27/083;
(Continued)

(56) References Cited

U.S. PATENT DOCUMENTS 2,489,596 A * 11/1949 Swain ..... F16K 37/00 137/553
5,090,077 A * 2/1992 Caden ..... A61G 7/05715 5/713

(Continued)

*Primary Examiner* — Nicholas F Polito
*Assistant Examiner* — Morgan J McClure
(74) *Attorney, Agent, or Firm* — Cantor Colburn LLP

(57) ABSTRACT

A self-adjusting, non-powered smart response technology mattress generally includes an accelerated calibration system comprising a valve fluidly connected to a body support device including a plurality of fluid support cells, wherein each fluid support cell includes an envelope and a reforming element disposed within the envelope; and a non-powered manifold system including a manifold conduit interconnecting at least two of the fluid support cells, and intake and exhaust valves fluidly coupled to the manifold conduit configured to dynamically open and close in response to a weight load. The accelerated calibration system is configured to selectively permit fluid flow out of the fluid support cells in the absence of a weight load upon opening of the valve. Also discloses is a process for releasing excess pressure formed as a result of temperature and barometric pressure changes in the self-adjusting, non-powered smart response technology mattress.

10 Claims, 4 Drawing Sheets

(51) Int. Cl.
*A47C 27/14* (2006.01)
*A47C 27/20* (2006.01)
*A47C 31/12* (2006.01)
*A47C 23/04* (2006.01)

(52) U.S. Cl.
CPC ..... *A47C 27/081* (2013.01); *A47C 27/10* (2013.01); *A47C 27/14* (2013.01); *A47C 27/20* (2013.01); *A47C 31/12* (2013.01)

(58) Field of Classification Search
CPC ..... A47C 27/088; A47C 27/10; A47C 27/20; A47C 27/085; A47C 27/08; A47C 27/14
See application file for complete search history.

(56) References Cited

U.S. PATENT DOCUMENTS 5,539,942 A * 7/1996 Melou ..... A61G 7/05776 5/655.3
6,269,505 B1 * 8/2001 Wilkinson ..... A47C 27/084 5/654
6,775,868 B1 * 8/2004 Mileti ..... A47C 27/001 5/710
6,826,795 B2 12/2004 Wilkinson
7,434,283 B2 * 10/2008 Wilkinson ..... A47C 27/084 5/710
7,617,554 B2 * 11/2009 Wilkinson ..... A47C 27/083 5/655.3
8,122,545 B2 2/2012 Wilkinson
2003/0192127 A1 * 10/2003 Cook ..... A47C 27/00 5/713
2005/0062284 A1 * 3/2005 Schreiner ..... F16K 15/202 285/139.1
2008/0028534 A1 * 2/2008 Wilkinson ..... A47C 27/083 5/713
2014/0090176 A1 * 4/2014 Boyd ..... A47C 27/10 5/710
2014/0319890 A1 * 10/2014 Rivera ..... A47C 7/467 297/284.4
2015/0034855 A1 * 2/2015 Shen ..... A47C 27/081 251/314

* cited by examiner

ACCELERATED CALIBRATION SYSTEM FOR A SMART RESPONSE TECHNOLOGY MATTRESS

CROSS-REFERENCE TO RELATED APPLICATIONS

This application is a NON-PROVISIONAL of and claims the benefit of U.S. Application No. 61/954,982, filed Mar. 18, 2014, which is incorporated herein by reference in its entirety.

BACKGROUND

The present disclosure generally relates to an accelerated calibration system for a smart response technology mattress.

Smart response technology (SRT) mattresses are non-powered air mattresses that include a system of fluidly connected foam-filled air chambers in the middle of the mattress. The foam filled air chambers utilize a pressure relief valve and a series of intake valves to pass air in and out of the system as load is applied and released. For example, the system dynamically adjusts to a variable applied load corresponding to the weight of a person as they move around on the SRT mattress, thereby displacing their weight to provide optimal pressure relief. The principles of SRT are based on Boyles' Law, which makes the system sensitive to temperature and barometric pressure changes. As temperature and/or barometric pressure changes, the SRT internal pressure can increase and cause the system/mattress to appear overinflated. Currently, there is no way to relieve that pressure inside the SRT system until a weight is applied to the mattress (i.e. a person sleeping).

BRIEF SUMMARY

Disclosed herein is a non-powered SRT mattress that includes an accelerated calibration system that rapidly equilibrates pressure without applied weight. In one embodiment, a self-adjusting, non-powered smart response technology mattress comprises a body support device comprising a plurality of fluid support cells, wherein each fluid support cell includes an envelope and a reforming element disposed within the envelope; a non-powered manifold system including a manifold conduit interconnecting at least two of the fluid support cells, and intake and exhaust valves fluidly coupled to the manifold conduit configured to dynamically open and close in response to a weight load; and an accelerated calibration system comprising a valve fluidly connected to the manifold conduit and configured to selectively permit fluid flow out from the fluid support cells in the absence of a weight load upon opening of the valve; and one or more layers overlaying the body support device and a side rail assembly circumscribing a perimeter of the body support device.

A process for releasing excess pressure formed as a result of temperature and barometric pressure changes in a smart response technology mattress, the process comprising opening a valve in fluid communication with an external environment and a non-powered, self-adjusting body support device, the body support device comprising a plurality of fluid support cells, wherein each fluid support cell includes an envelope and a reforming element disposed within the envelope, a manifold conduit interconnecting at least two of the fluid support cells, and intake and exhaust valves fluidly coupled to the manifold conduit configured to dynamically open and close in response to a weight load, wherein opening of the valve is in the absence of an applied load to the body support device.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
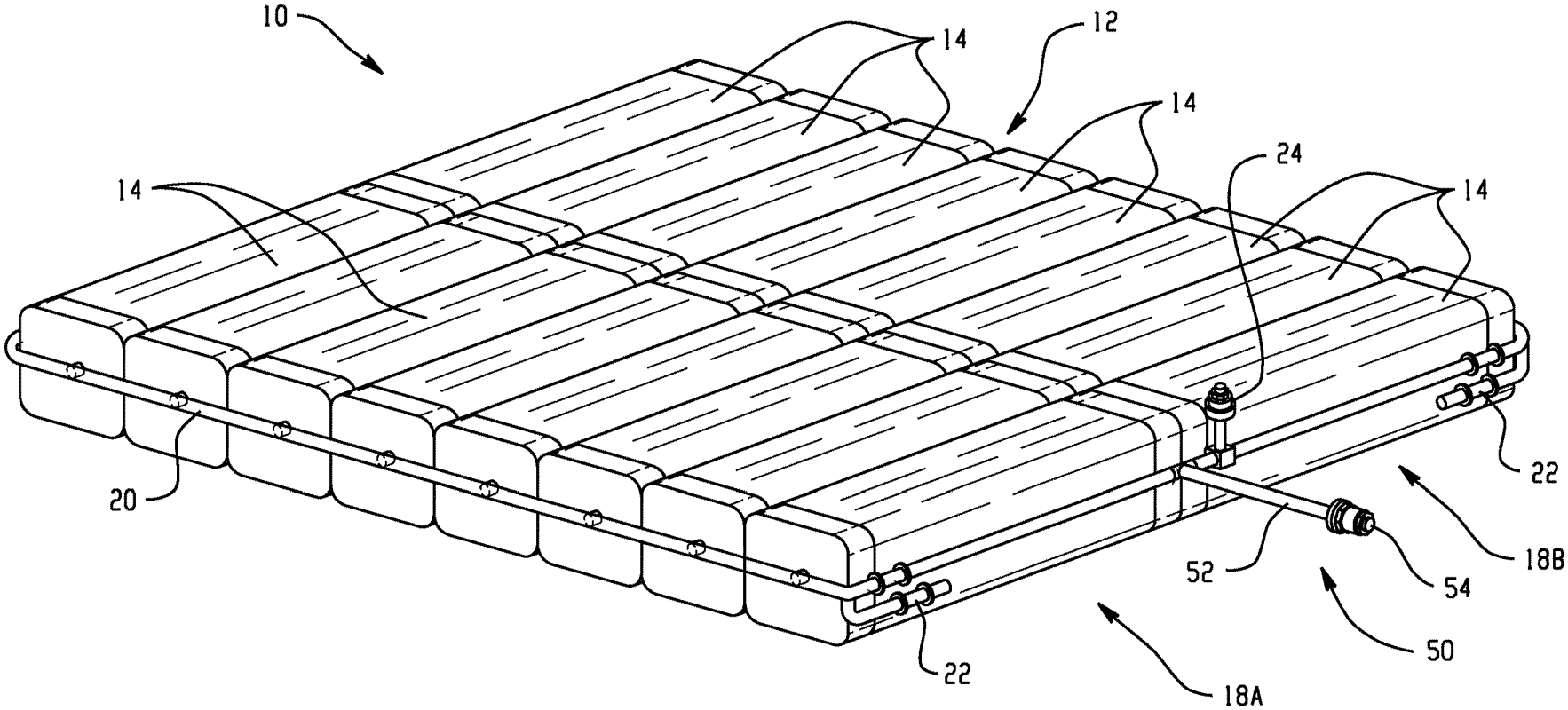
FIG. 1 illustrates a perspective view of a body cushioning device including an accelerated calibration system for use in a mattress.

Disclosed herein are smart response technology (SRT) mattresses that include an accelerated calibration system that rapidly equilibrates pressure without applied weight, thereby solving the problem associated with changing environmental temperatures and barometric pressures. Suitable SRT mattresses that can be configured with the accelerated calibration system are disclosed in US Pub. No. 2008/0028534; and U.S. Pat. Nos. 7,434,283; 8,122,545; 7,617,554; 6,826,795; and 6,269,505, the disclosures of which are incorporated by reference in their entireties. As will be discussed in greater detail below, the SRT mattresses generally include at least one support cell for providing lifting support for a body, wherein each support cell includes an envelope containing a fluid. Application of an external load on an outer surface of the envelope causes the envelope to deform into a compressed form. The envelope includes a reforming element disposed therein that is capable of providing a reforming force to the interior surface of the envelope and return the envelope to its original unloaded form once the load is removed. An exemplary reforming element is a resilient foam material; however, other resilient materials and means can be used.

An intake valve and an exhaust valve are typically in fluid communication with each support cell. The exhaust valve in each support cell can be connected to an exhaust control system. The intake valve in each support cell can be connected to an intake control system. Each intake valve includes an intake check valve allowing fluid to flow into the support cell, while preventing fluid from flowing out of the support cell. Each exhaust valve can include an exhaust check valve allowing fluid to flow out of the support cell, while preventing fluid from flowing into the support cell. The intake control system can be connected to a fluid supply reservoir. The exhaust control system can be connected to a fluid exhaust reservoir. Preferably, the fluid included in the supply and exhaust reservoirs is air, however, any suitable fluid, e.g., water or nitrogen, can be used. The fluid supply and exhaust reservoirs may comprise the same reservoir, and may comprise an ambient source of fluid such as atmospheric air.

The SRT mattresses may be of any size, including standard sizes such as a twin, queen, oversized queen, king, or California king sized mattress, as well as custom or non-standard sizes constructed to accommodate a particular user or a particular room. The mattresses can include a base layer, one or more padding layers overlaying the support cells, a quilt cover layer, a side rail assembly, and the like. The support cell(s), also referred to herein as a cushioning device, are typically encased by the various layers and side rail assembly to define the mattress.

The principles of the SRT system are based on Boyles' Law, which makes the system sensitive to temperature and barometric pressure changes. As temperature and/or barometric pressure changes, the SRT internal pressure can increase and cause the system/mattress to appear overinflated. Deflation due to changes in temperature and barometric pressure is less of a concern since the reforming element will generally prevent the mattress to deflate to any appreciable degree. Currently there is no way to relieve that pressure inside the SRT system until a weight is applied to the mattress (i.e. a person sleeping). Once a weight is applied, the process of returning the system back to its normal height is very lengthy and can often take greater than an hour or more to complete for each side of the mattress.

The accelerated calibration system as described herein is a means to quickly exhaust all excess air inside the SRT system and return it back to normal height. Because SRT is based on the principles of Boyles' Law, the SRT system can become over-inflated when there are changes in temperature and/or barometric pressure. Using this disclosure, a SRT system/mattress can be fully calibrated in less than five minutes and it can be performed at any stage in the supply chain because the process does not require anyone to lie on the mattress, i.e., no load is required.

In one embodiment, the accelerated calibration system includes a conduit fluidly connected to the non-powered manifold system of the SRT mattresses. At a distal end of the conduit is a valve that can be manually or automatically activated to equilibrate pressure without an applied load on the mattress. In one embodiment, the valve is push button activated to activate (i.e., open) or deactivate (i.e., close) the valve. Alternatively, the valve may be configured for activation by use of a toggle, dial, switch, knob, and the like. A pressure relief valve is typically included in the exhaust control system of the SRT mattress so that a maximum pressure level of the fluid within the envelope can be set and maintained. Different selected maximum pressure levels of the fluid allow the support cell to accommodate different weights or allow different degrees of conformation between the user and the envelope surface. Preferably, the maximum pressure level of the fluid is set to ensure that the interface pressure under the entire contact surface of the user is below the pressure that may cause soft tissue damage such as pressure sores to occur such as may be desired for medical beds.

Advantageously, activation of the valve in the accelerated calibration system serves to bypass operation of the pressure relief valve that is typically provided in the SRT mattress. This function can be performed during manufacturing, on a dealer's show floor, or in a consumer's home. By activating the valve, the disclosure bypasses the normal SRT pressure relief valve to quickly release air and normalize the SRT system. In one embodiment, the accelerated calibration system is connected directly to the SRT system and extends to the outer edge of the mattress via plastic tubing as will generally be described below.

Referring now to FIG. 1, there is illustrated a perspective view of an exemplary SRT based cushioning device 10 including the accelerated calibration system 50 in accordance with the present disclosure. As discussed above, the SRT based cushioning device can be encapsulated in numerous other layers (not shown) to define a mattress, the particular configuration is not intended to be limited to any particular layers or materials. It should also be apparent to those skilled in the art that the accelerated calibration system can be used in combination with any SRT based cushioning device where self-adjusting dynamic pressure support of a person is desired, e.g., mattress, sofa, seat, and the like. The accelerated calibration system provides a relatively quick means for calibration and can be performed at any stage in the supply chain because the valve within the accelerated calibration system provides instant pressure relied. Advantageously, the process does not require anyone to lie on the cushioning device to effect calibration.

The exemplary cushioning device 10 includes a support system apparatus 12 comprising at least one support cell 14 for providing lifting support for a user. In the illustrated exemplary embodiment, there are 16 support cells arranged in two abutting columns 18A, 18B, wherein each column includes eight support cells. Each support cell 14 is fluidly coupled to a common conduit 20. The conduit 20 includes at least one intake valve 22, two of which are depicted, and at least one exhaust valve 24, one of which is shown, to collectively define a manifold. The accelerated calibration system 50 is fluidly coupled to the non-powered manifold conduit 20.

Figure 2:
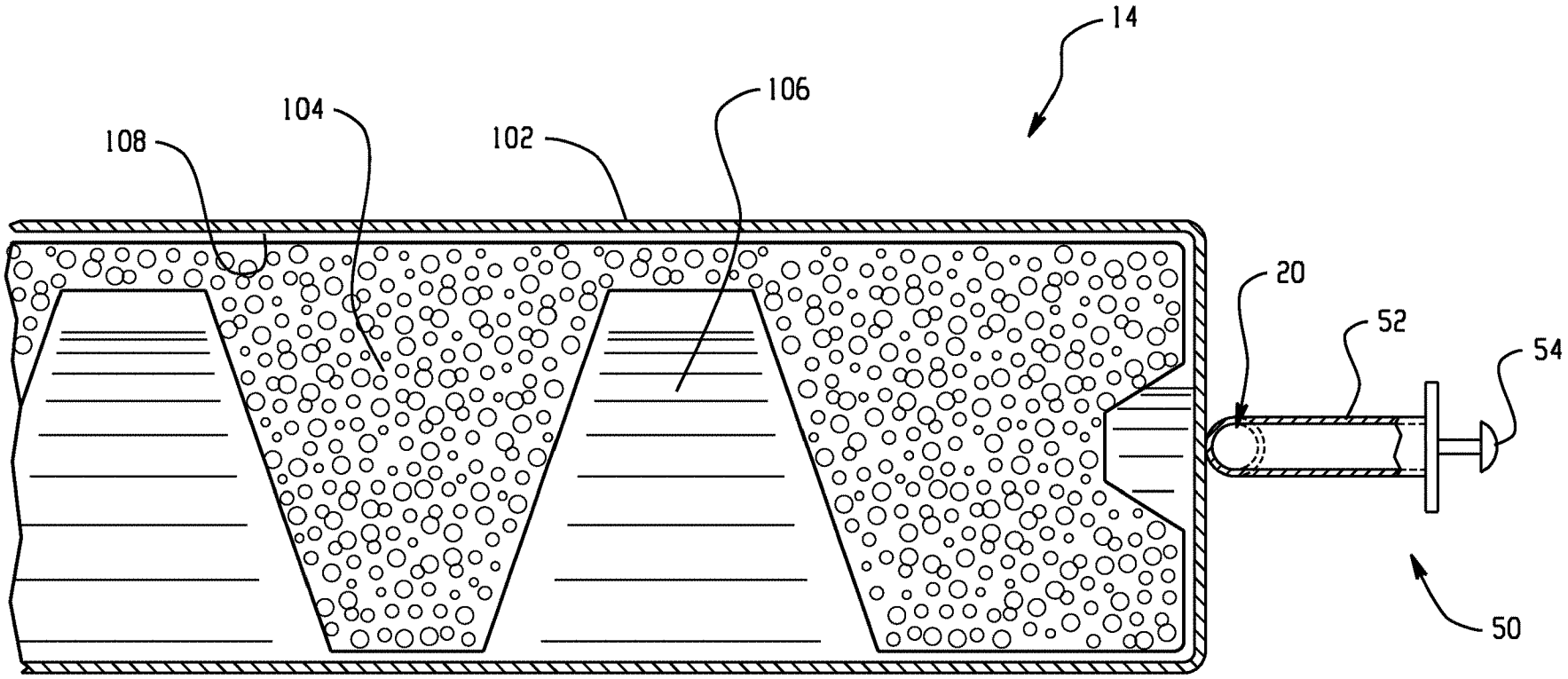
FIG. 2 illustrates a partial cross sectional view of a support cell and the accelerated calibration system of FIG. 1.
Figure 3:
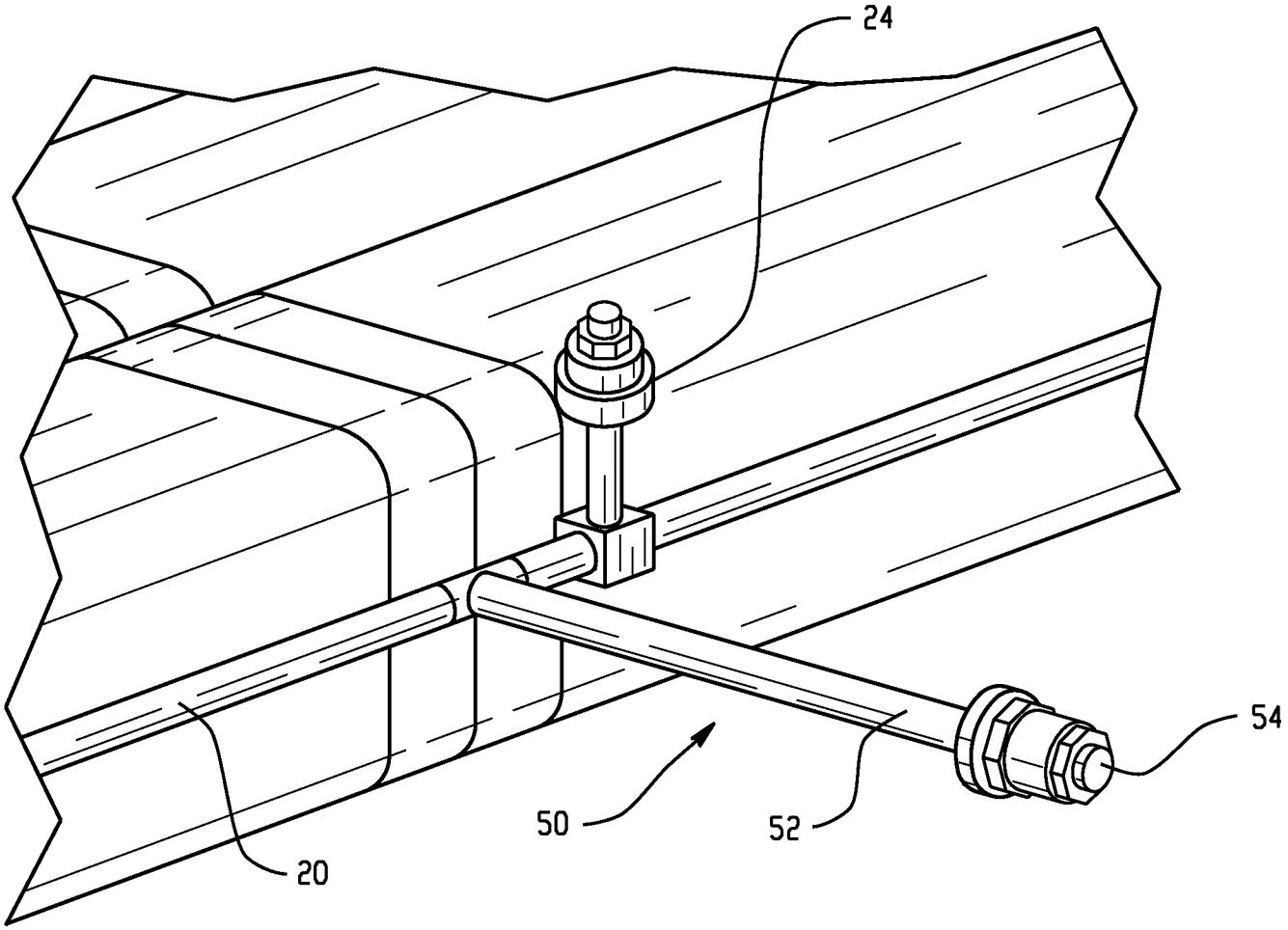
FIG. 3 illustrates a partial perspective view of the body cushioning device and the accelerated calibration system of FIG. 1.

FIGS. 2 and 3 illustrate enlarged partial cross-sectional and partial perspective views, respectively, of the support cell 14 including the accelerated calibration system 50. Each individual support cell 14 includes an envelope 102 and a reforming element 104 disposed therein. The envelope 102 also contains a fluid 106. During use, application of an external load on the envelope 102 causes the envelope 102 to deform into a compressed form and air to be discharged into the manifold conduit 20. The reforming element 104 provides a reforming force to the interior surface 108 of the envelope 102 and causes the envelope 102 to return relatively slowly to its original form when the external load is removed from the envelope 102. The reforming element 104 can be a resilient foam material, however, other resilient materials and means can be used such as a coiled spring, bellows or the like. By way of example, the coiled spring can be surrounded by another resilient material such as a foam. The bellows may be formed from a pliable resilient material such as plastic and filled with a fluid such as air.

The accelerated calibration system 50 is fluidly connected to the non-powered manifold conduit 20 via conduit 52 and is shown in FIG. 1 as being adjacent the manifold exhaust valve 24. A spring loaded push button 54 is coupled to an end of the conduit 52 in fluid communication with the manifold conduit 20 that functions to open a valve disposed therein when depressed, thereby permitting excess fluid to rapidly discharge without an applied weight load to the support cell 14. In this manner, pressure is rapidly equilibrated without any applied weight, thereby solving the problem associated with changing environmental temperatures and barometric pressures. It should be apparent that the location of the accelerated calibration system 50 is not intended to be limited. The accelerated calibration system 50 can be fluidly coupled to the manifold conduit of the SRT cushioning device at any location. Likewise, the length and shape of the conduit 52 in fluid communication with the manifold conduit 20 is not intended to be limited. Still further, activation of the valve can be by any means so long as the valve can be selectively opened and closed, for example, a rotatable knob, toggle, and the like.

In contrast, the exhaust 24 and intake valves 22 fluidly coupled to manifold conduit 20 are non-powered valves configured to selectively open and close in response to a load being applied or removed as a function of pressure. For example, each intake valve 22 includes an intake check valve allowing fluid to flow into the support cell 14, while preventing fluid from flowing out of the support cell 14. Each exhaust valve 24 operates in a similar manner and includes an exhaust check valve allowing fluid to flow out of the conduit 20 while preventing fluid from flowing back into the conduit 20 As shown more clearly in FIG. 1, the exhaust valve 24 and intake valve 22 are fluidly connected to a common manifold conduit 20.

In this manner, the weight of a user body resting on the cushion device 10 deforms the envelope 102 in each support cell 14. The pressure of the fluid within the envelopes 102 increases as the volume of the envelope 102 decreases under deformation. As the pressure of the fluid increases, the fluid in each envelope 102 flows out of one envelope 102 through conduit 20, which is then distributed to other support cells or exhausted to the fluid exhaust valve 24. Furthermore, as each envelope 102 deforms to conform to the irregular shape of the user, the area of the envelope 102 supporting the load increases. Equilibrium is achieved when the forces within the envelope 102, including the pressure of the fluid within the envelope multiplied by the area of the envelope supporting the load, plus the force provided by the reforming element, equal the weight of the load.

As the weight of the user is removed from each support cell 14, the reforming element 104 (FIG. 2) in each envelope 102 exerts a reforming force on the interior surface of each envelope. As each envelope expands, a partial vacuum is created in the interior space 106 of each envelope 102 The vacuum draws the fluid from the fluid supply reservoir (not shown) into the intake control system. Next, the fluid is drawn from the intake control system through a corresponding intake valve 22 into the interior space of each envelope. When the fluid supply reservoir and the fluid exhaust reservoir can comprise atmospheric air, inflation can be accomplished without the need for expensive blowers, pumps or microprocessors as required by previously available "treatment products." When the pressure distribution applied to the cushioning device 10 changes, the support cells 14 within the support system automatically inflate or deflate to restore the low interface pressure under the entire user.

The SRT system may further include a controllable pressure relief valve to control the maximum pressure level of the fluid in the conduit and in each envelope of each support cell 14. An adjusting mechanism such as a rotatable knob on the controllable pressure relief valve can be configured to allow a user to adjust the regulated maximum pressure level. Different selected maximum allowable pressures in the support cells allow the support system apparatus 12 to accommodate users of different weights and different weight distributions. Also, the setting of different maximum allowable pressures in the support cells 14 allows different degrees of conformation between the user and the surface of each envelope. The maximum pressure can be above about 6 inches of water and is commonly in the range of about 8 to 12 inches of water. Other ranges may also be used, depending on operational requirements, user preferences, etc.

Figure 4:
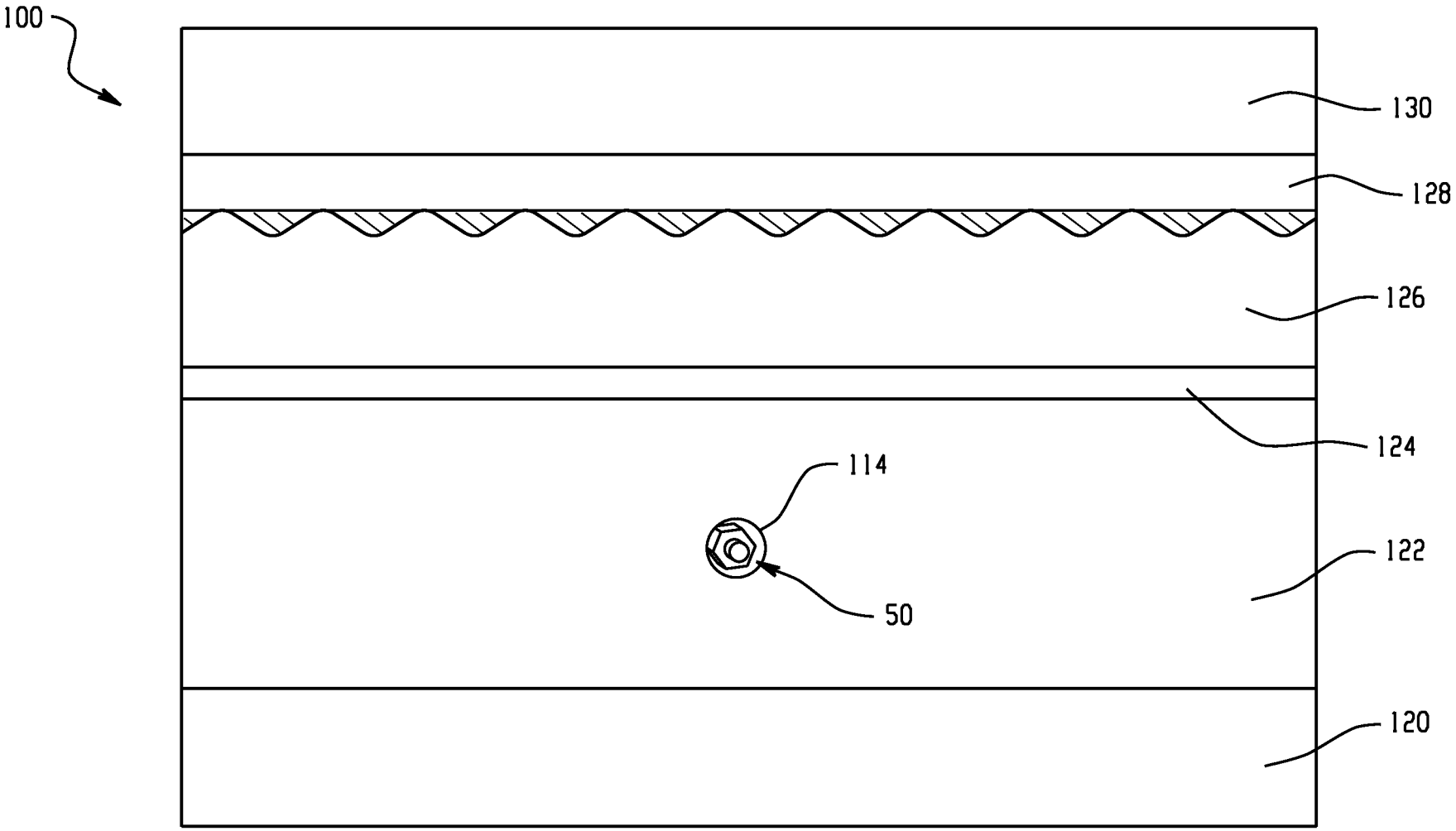
FIG. 4 illustrates an angled side view of a mattress illustrating an access opening disposed within a side rail assembly circumscribing a perimeter of the body cushioning device.

As shown in FIG. 4, an SRT mattress 100 including the body cushioning device as described above may further include a base layer 120, a side rail assembly 122 disposed about a perimeter of the SRT cushioning device, one or more padding layers 124, 126, 128, 130 overlaying the support cells, a quilt cover layer (not shown), and the like. When surrounded by atmospheric air, the cushioning device is self-inflating, self-adjusting, and does not require expensive pumps and control systems. Advantageously, the accelerated calibration system is readily integrated with the SRT conduits and can be employed to regulate the changes in pressure (increase or decrease) as a consequence of changing environmental temperatures and barometric pressures. As shown, access to the accelerated calibration system 50 may include an access opening 114 in the side rail assembly 122 that permits an end user to actuate the system, e.g., push a spring loaded button, toggle a switch valve, rotate a knob, and the like. The cushioning device of the present invention can be used in combination with any support device where self-adjusting dynamic pressure support of the person is desired. For example, these support devices can be mattresses, sofas, seats, etc.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A self-adjusting, non-powered smart response technology mattress comprising:

a body support device comprising:

a plurality of fluid support cells, wherein each fluid support cell includes an envelope and a reforming element disposed within the envelope to provide the envelope with an original form;

a non-powered manifold system including a manifold conduit interconnecting at least two of the fluid support cells, and intake and exhaust pressure relief valves fluidly coupled to the manifold conduit configured to dynamically open and close at respective pressure ratings for the intake and exhaust pressure relief valve to self-adjust pressure in response to a weight load; and an accelerated calibration system free of a pumping mechanism comprising a valve fluidly connected to the manifold conduit and configured to bypass the intake and exhaust pressure relief valves, wherein the valve of the accelerated calibration system is configured to selectively permit fluid flow from the fluid support cells in the absence of a weight load upon opening of the valve and in response to a change in barometric pressure that inflates the original form; and one or more layers overlaying the body support device and a side rail assembly circumscribing a perimeter of the body support device, wherein the smart response technology mattress is free of a powered pump.

2. The mattress of claim 1, wherein the valve fluidly connected to the manifold conduit comprises a conduit having a proximal end in fluid communication with the manifold conduit and a distal end having an opening in fluid communication with an external environment, wherein the valve is coupled to the distal end conduit to selectively permit fluid flow to the external environment.

3. The mattress of claim 1, wherein the reforming element is a foam body and is encapsulated in an envelope.

4. The mattress of claim 1, wherein the valve is coupled to a spring loaded button.

5. The mattress of claim 1, wherein the reforming element is a coil encased in a foam body.

6. The mattress of claim 1, wherein the reforming element is a bellows.

7. The mattress of claim 1, wherein the fluid in the fluid support cells is air.

8. The mattress of claim 1, wherein the side rail assembly includes an access opening, and the valve is recessed within the side rail assembly.

9. A process for releasing excess pressure formed as a result of barometric pressure changes in a self-adjusting, non-powered smart response technology (SRT) mattress, the process comprising:

providing the SRT mattress with an accelerated calibration system free of a pumping mechanism comprising a valve fluidly connected to a manifold conduit interconnecting a plurality of fluid support cells, wherein each fluid support cell includes an envelope and a reforming element disposed within the envelope, wherein the manifold conduit includes intake and exhaust pressure relief valves configured to dynamically open and close in response to a weight load, and wherein the accelerated calibration system is configured to bypass the intake and exhaust pressure relief valves; and opening the valve in fluid communication with an external environment and the manifold conduit in the absence of an applied load and in response to a change in barometric pressure that inflates the envelope.

10. The process of claim 9, wherein opening the valve comprises pushing a spring loaded button fluidly coupled to a conduit in fluid communication with the manifold conduit.

* * * * *